US012662791B2

(12) United States Patent
Kraft

(10) Patent No.: US 12,662,791 B2
(45) **Date of Patent: *Jun. 23, 2026**

(54) SYSTEMS, METHODS, AND MACHINES FOR DETECTING REQUIRED MAINTENANCE WITH A STALL DETECTION AND MITIGATION ROUTINE IN AN AUTOMATED FOUNDATION COMPONENT DRIVING AND TRUSS ASSEMBLY MACHINE

(71) Applicant: Ojjo, Inc., San Rafael, CA (US)

(72) Inventor: Steve Kraft, Albany, CA (US)

(73) Assignee: OJJO, INC., San Rafael, CA (US)

( * ) Notice: Subject to any disclaimer, the term of this patent is extended or adjusted under 35 U.S.C. 154(b) by 185 days.

This patent is subject to a terminal disclaimer.

(21) Appl. No.: 18/520,322

(22) Filed: Nov. 27, 2023

(65) Prior Publication Data

US 2025/0171976 A1 May 29, 2025

Related U.S. Application Data

(63) Continuation-in-part of application No. 18/137,694, filed on Apr. 21, 2023.

(Continued)

(51) Int. Cl.

| | |
|---|---|
| ***E02D 7/14*** | (2006.01) |
| ***E02D 13/00*** | (2006.01) |
| ***E21B 44/00*** | (2006.01) |

(52) U.S. Cl.

CPC ..... *E02D 7/14* (2013.01); *E02D 13/00* (2013.01); *E21B 44/00* (2013.01)

(58) Field of Classification Search

CPC .. E02D 7/14; E02D 7/22; E02D 13/00; E21B 44/00; E21B 7/022

See application file for complete search history.

(56) References Cited

U.S. PATENT DOCUMENTS 4,793,421 A 12/1988 Jasinski
5,978,749 A * 11/1999 Likins, Jr. ..... E02D 13/00 702/158

(Continued)

FOREIGN PATENT DOCUMENTS

EP 3613903 A1 * 2/2020 ..... E02D 7/06

OTHER PUBLICATIONS

International Searching Authority, "International Search Report and Written Opinion", From Application No. PCT/US2023/19421, Mailed Jul. 20, 2023, pp. 10.

*Primary Examiner* — Amber R Anderson
*Assistant Examiner* — Stacy N Lawson
(74) *Attorney, Agent, or Firm* — Fredrikson & Byron, P.A.

(57) ABSTRACT

An automated driving and assembly machine for driving foundation components, such as screw anchors, and for assembling foundations, such as truss foundations, using the driven screw anchors. The machine has a rotary driver and a hydraulic drilling tool. Sensors monitoring hydraulic pressure at the drilling tool will take incremental pressure readings during a driving operation. If the readings become clustered around a relative maximum, the controller will pause the driving operation and begin a drill stall mitigation sub-routine. This may involve retracting the drill and then hammering and releasing pressurized air to clear the stall. Clearance of the stall may also be derived by the controller from pressure readings. If the relative maximum is below a predetermined threshold, this is indicative of a malfunction of the hydraulic system. As a result, the controller will generate a service flag for the hydraulic system to a user interface of the machine to alert an operator of the need to have the machine serviced.

16 Claims, 9 Drawing Sheets

Related U.S. Application Data

(60) Provisional application No. 63/333,355, filed on Apr. 21, 2022.

(56) References Cited

U.S. PATENT DOCUMENTS

| | | | | |
|---|---|---|---|---|
| 6,641,332 | B1 * | 11/2003 | Alvarado | E02D 5/52 175/323 |
| 2011/0108323 | A1 | 5/2011 | Stacy, II | |
| 2011/0162888 | A1 | 7/2011 | Mchugh et al. | |
| 2013/0032401 | A1 | 2/2013 | Edbury et al. | |
| 2019/0323335 | A1 | 10/2019 | Ocegueda-Hernandez et al. | |
| 2020/0032831 | A1 * | 1/2020 | Almy | E02D 27/14 |
| 2020/0149241 | A1 * | 5/2020 | Flanigan | E02D 13/00 |
| 2020/0217034 | A1 * | 7/2020 | Karkheck | E02D 7/06 |
| 2021/0198860 | A1 | 7/2021 | Flanigan et al. | |
| 2021/0270097 | A1 | 9/2021 | Ng et al. | |
| 2023/0383603 | A1 * | 11/2023 | Ditillo | E21B 7/024 |

* cited by examiner

SYSTEMS, METHODS, AND MACHINES FOR DETECTING REQUIRED MAINTENANCE WITH A STALL DETECTION AND MITIGATION ROUTINE IN AN AUTOMATED FOUNDATION COMPONENT DRIVING AND TRUSS ASSEMBLY MACHINE

CROSS-REFERENCE TO RELATED APPLICATIONS

This is a continuation-in-part of U.S. patent application Ser. No. 18/137,694 filed on Apr. 21, 2023, titled "SYSTEMS, METHODS, AND MACHINES FOR DETECTING AND MITIGATING DRILL STALLS WITH AN AUTOMATED FOUNDATION COMPONENT DRIVING AND TRUSS ASSEMBLY MACHINE," which claims priority to U.S. provisional patent application 63/333,355, filed on Apr. 21, 2022, titled, "SYSTEMS, METHODS, AND MACHINES FOR DETECTING AND MITIGATING DRILL STALLS WITH AN AUTOMATED FOUNDATION COMPONENT DRIVING ASSEMBLY MACHINE", the disclosures of which are hereby incorporated by reference in their entirety.

BACKGROUND

The applicant of this disclosure has developed a novel foundation system for supporting single-axis solar trackers, fixed tilt solar arrays and other solar and non-solar structures. Known commercially as EARTH TRUSS, this foundation system consists of a pair of adjacent legs extending above and below ground that form a truss with the ground. In some embodiments, each leg of the EARTH TRUSS is formed from a foundation component known as a screw anchor that is driven into the ground and an upper tubular section known as an upper leg. The upper leg is attached to the top of the screw anchor and the free ends of each upper leg are then joined into a unitary truss foundation with a so-called truss cap or truss adapter. Different length upper legs may be used to accommodate different heights, stances, screw anchor embedment depths, and leg angles. In the case of various single-axis trackers, the tracker bearing assembly is attached to the truss cap. In other cases, the tracker bearing may be incorporated into the truss cap in what may be called a bearing adapter.

The EARTH TRUSS foundation provides several advantages over conventional H-pile foundations when supporting single-axis trackers, however, its multi-piece construction also creates additional complexity. To construct EARTH TRUSS foundations quickly and accurately at the scale required for solar power plants, the applicant also had to develop a novel machine to drive the base underground component into the ground and to facilitate accurate assembly of the truss to those driven components. This machine, known commercially as a truss driver, combines a rotary driver and a drilling tool concentrically oriented on the same mast controlled by precision automation. Automation takes operator delay and variations out of the loop to ensure that a given machine will drive each screw anchor using the same program and will respond to detected conditions in real time to prevent and/or mitigate any issues as they occur. A greater discussion of automated driving operations may be found in commonly assigned patent application Ser. No. 16/659,440, now issued U.S. Pat. No. 10,907,318, the disclosure of which is hereby incorporated by reference in its entirety.

As shown and discussed herein, the drilling tool of the truss driver extends through the rotary driver and driven foundation component to clear obstacles and drill a path for the screw anchor through hard soils and even solid rock while the rotary driver embeds the screw anchor. Drilling through the component during driving obviates the need for a separate pre-drill step and results in tighter tolerances of truss components relative to pre-drilling. Pre-drill is more expensive because it requires a separate machine, is less precise because the same bore is drilled each time, and can suffer from cave-in necessitating other remediation. Also, because the EARTH TRUSS is assembled while the machine remains oriented above the foundation location, the resulting foundation is normally ready for tracker installation without a subsequent alignment correction step normally required for H-piles.

By using an expanding drill bit passed through the screw anchor, the borehole diameter can be controlled by the distance the bit is extended out of or ahead of the screw anchor. In fact, the expanding bit enables the borehole to have a wider diameter than the inside diameter of the foundation component which, in turn, enables the external thread form at the lower end of each anchor to engage with the surrounding media, even if it is solid rock. However, like the truss itself, these additional controllable features require additional control over the drilling process to prevent damaging the bore hole (over excavating), damaging the screw anchor by forcing into a hole that it will not screw into, and even damaging the drill bit or drilling tool itself. With any drilling operation, it is possible for the drilling operation to stall, that is, when further torque and downforce fail to result in further penetration of the bit. When this happens, it can damage the bit, the drill rod, the hydraulic system, and even the foundation component being driven before a human operator is aware or has the opportunity to stop the automated drilling operation to attempt to mitigate the stall. In recognition of this problem, various embodiments of this disclosure provide systems, methods, and machines that leverage the automation of the truss driver machine to identify situations requiring mitigation quickly and autonomously and to perform mitigations strategies before any damage to any tools or components occurs.

In various embodiments, the same system automation used to detect and mitigate drill stalls may also be used to trigger service flags for the machine's hydraulic system. These and other non-limiting embodiments will be apparent from the following drawings and detailed description.

DETAILED DESCRIPTION

The following description is intended to convey a thorough understanding of the embodiments described by providing a number of specific embodiments and details involving control systems for foundation component driving machines. It should be appreciated, however, that the present invention is not limited to these specific embodiments and details, which are exemplary only. It is further understood that one possessing ordinary skill in the art in light of known systems and methods, would appreciate the use of the invention for its intended purposes and benefits in any number of alternative embodiments, depending upon specific design and other needs, including pile driving and drilling machines generally.

Figure 1:
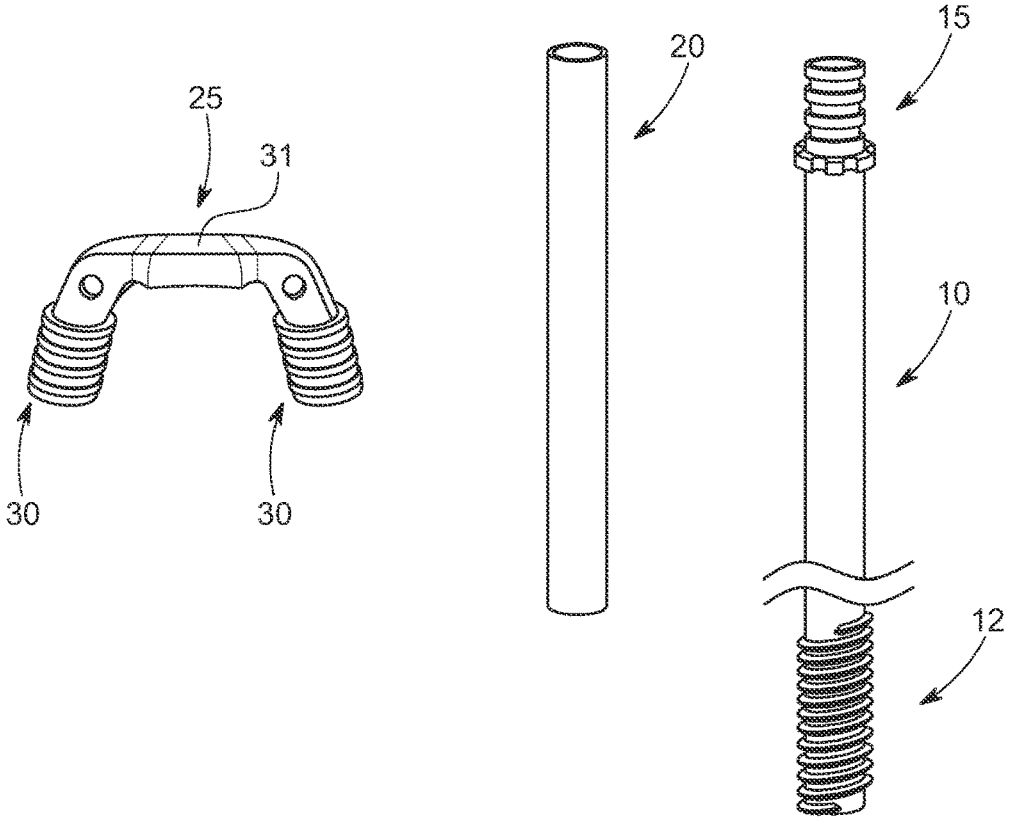
FIG. 1 shows components of an exemplary truss foundation according to various embodiments of the invention.
Figure 2:
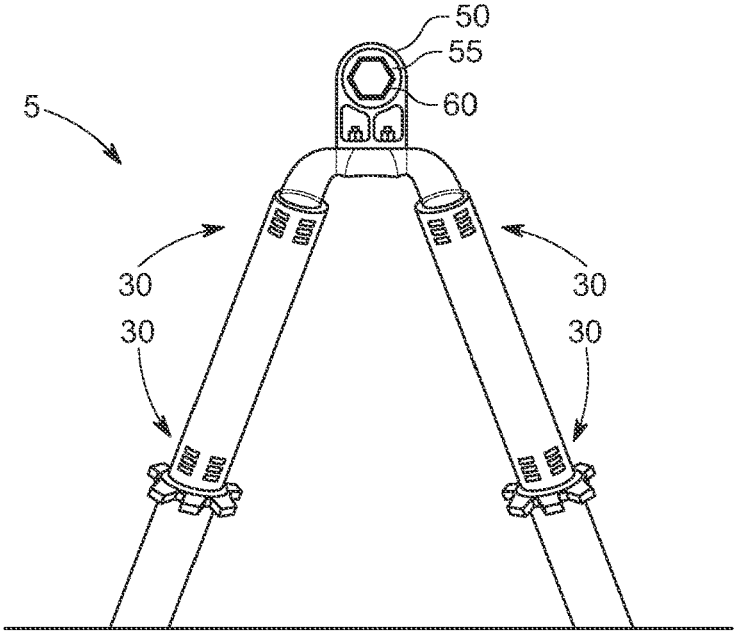
FIG. 2 shows an exemplary assembled truss foundation using the components shown in FIG. 1 according to various embodiments of the invention.

Turning now to the drawing figures, FIG. 1 shows components of the EARTH TRUSS foundation system according to at least one exemplary embodiment of the invention and FIG. 2 shows a complete EARTH TRUSS foundation assembled from the components shown in FIG. 1. As illustrated, this system consists of screw anchor components 10, upper legs 20 and an apex component 25 identified as a truss cap or adapter. These components are assembled to form complete truss foundation 5. Screw anchor 10 is a hollow steel tube with an external thread form 12 at the lower end and a driving coupler 15 at the opposing, upper end. Driving coupler 15 as shown, is a cast piece attached to or welded to the upper end of screw anchor 10 that has a ring of teeth circumscribing its outer diameter. In various embodiments, these teeth are engaged by corresponding voids formed in the chuck of the rotary driver of the truss driver machine. This enables the rotary driver to impart torque and downforce without needing to be mechanically locked to the head of the screw anchor with pins or other devices that must be removed before the machine can be decoupled from the component. Upper leg 20, as shown, is a section of hollow, galvanized steel pipe. Truss cap 25 as shown is another single casting with a pair of opposing connecting portion 30 and an upper support surface 31. Upper support surface 31 provides a mounting platform for a bearing assembly of a single-axis tracker. The bearing assembly shown in FIG. 2 is that of conventional top-down style tracker such as that manufactured and sold by Array Technologies Inc. of Albuquerque, NM. Truss caps that support other tracker maker's systems may have different geometries designed to match with the specific bearing component being supported. The various embodiments of the invention are agnostic as to which type of tracker is being supported.

Assembly of the truss foundation shown in FIG. 2 with the components of FIG. 1 is accomplished in various exemplary embodiments by driving a pair of adjacent screw anchors into the ground at opposing angles to one another to straddle an intended North-South tracker row with a truss driver machine. Then, the drilling tool and rotary driver are retracted and the mast of the machine is moved to an alignment orientation that insures the truss cap is held at the desired orientation relative to the yet to be installed tracker torque tube by a jig, holder, or other device on the mast. This orientation will be dictated in various embodiments by a desired position of the tracker's rotational axis relative to the work point of the truss, i.e., the imaginary point of intersection of a line through the center of each truss leg. Upper legs at the appropriate length are sleeved over the connecting portions of the truss cap while it is held in place and down over one of the couplers of one of the driven screw anchors, resting against the teeth. Once all components are in place, hydraulic crimping devices attached to the machine are removed from their stowed position, placed over the upper legs where they overlap the truss cap connecting portions and the coupler on each screw anchor, and engaged to deform the upper leg into the recesses on each connecting portion and coupler. This locks the geometry of the truss legs in place. The truss cap is unlocked from the jig or holder and the machine is tracked ahead to the next foundation location so that the process may be repeated until the end of the tracker row is reached. In various embodiments, a human operator may walk along the machine to the next survey marker. In other embodiments, the machine may track automatically using GPS and/or a combination of GPS and laser alignment to reach the next foundation location in the row.

Figure 3A:
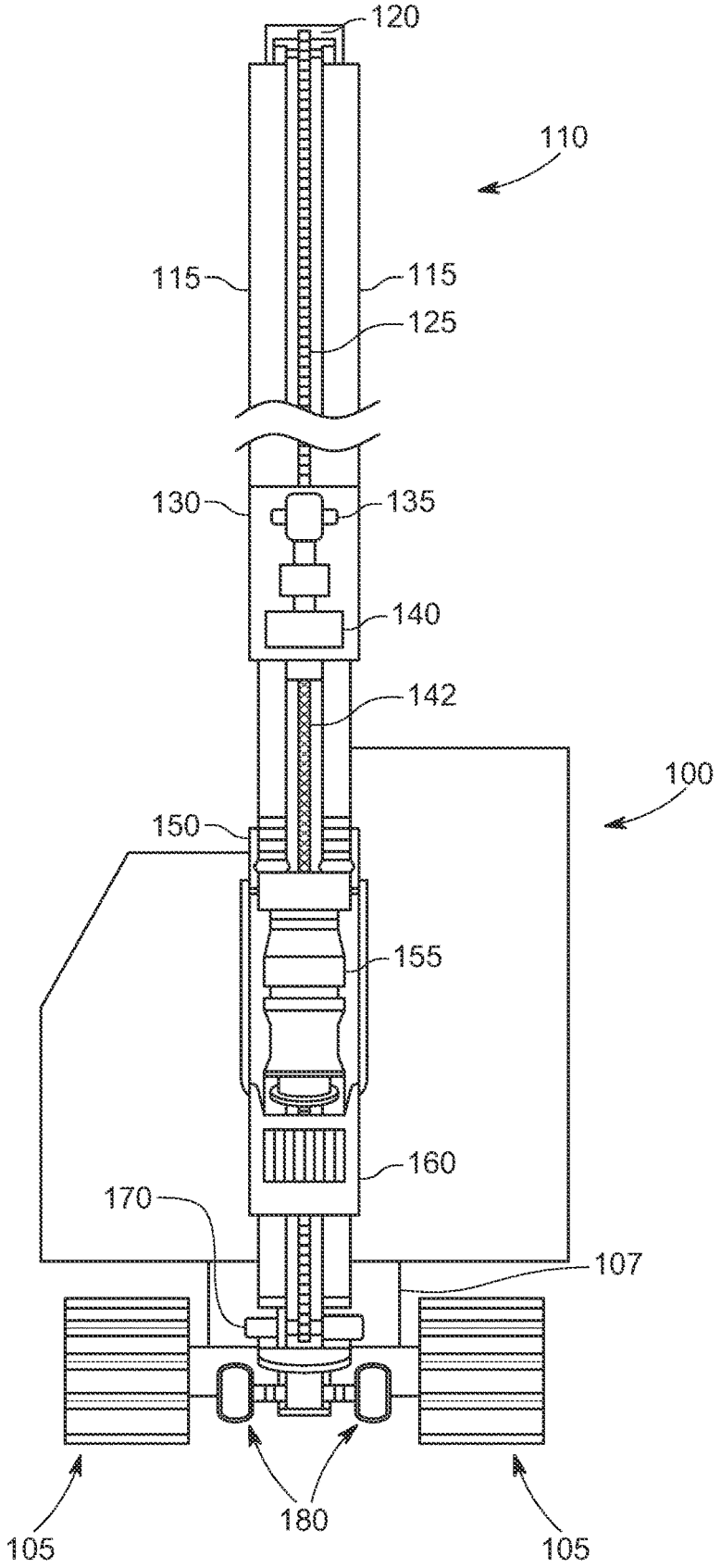
FIG. 3A is a mast or rear view of an exemplary machine for driving foundation components and assembling truss foundations according to various embodiments of the invention.

FIG. 3A shows an exemplary truss driver machine for embedding foundation components and assembling Earth Truss foundations according to at least one exemplary embodiment of the invention. As shown in FIG. 3A, truss driver machine 100 is a piece of heavy equipment riding on a tracked chassis 107 with a diesel motor and onboard hydraulic system powered by the diesel motor. An articulating mast 110 at the back end of the machine can move between vertical and horizontal orientations for use and stowing respectively. The connection between the machine and mast also allows the latter to move in X, Y, Z and to adjust in pitch, yaw and roll with respect to the machine so that the truss cap will achieve the desired orientation relative to the intended location of the torque tube regardless of the orientation of the machine or contour of the underlying ground.

Mast 110, as shown, extends in a straight-line 20+ feet and has a pair of parallel rails 115 extending along its length. A drive chain 125 runs between rails 115 between chain tensioners 120 at either end of the mast. A lower hydraulic crowd motor 170 powers drive chain 125 moving the lower and upper crowd sleds (130, 150 respectively) up and down mast 110 along parallel rails 115. Lower crowd 150 holds the rotary driver 155 and target plate 160. Rotary driver 155 at its bottom end accepts the head of a screw anchor or other foundation component and applies torque to drive it into the ground once the mast is oriented to the correct driving location and orientation. Simultaneous downforce comes from lower crowd motor 170. An automated controller, not shown in FIG. 3A, typically located in a control panel, controls rotary driver 155 and lower crowd motor 170 to supply the appropriate amount of torque and downforce to drive a screw anchor until it reaches the target embedment depth. Upper crowd 130 is positioned on mast 110 above lower crowd 150 and includes a separate upper crowd motor 135 that enables it to move along the drive chain independent of the movement caused by lower crowd motor 170. Upper crowd 130 also carries drilling tool 140, such as, for example, a hydraulic drifter. Drill rod 142 attached to the output of drilling tool 140 extends from the drilling tool, along the mast, and through rotary driver 155 and the attached foundation component to provide drill assist during the screw anchor embedment operation. Using a planetary gear system or other suitable mechanical assembly, rotary driver 155 has a hollow passage through its center that allows drill rod 142 to pass through without mechanical interference. In various embodiment, the controller can selectively engage and control upper crowd motor 135 and drilling tool 140 to change its position relative to lower crowd 150, to turn the drill on and off, to turn hammering by the drilling tool on and off and for other reasons, as necessary. In other words, the drill may have a different feed and speed than the driven foundation component, or, in some cases, it may be desirable to move the drill along the mast while the rotary driver remains temporarily fixed.

Figure 3B:
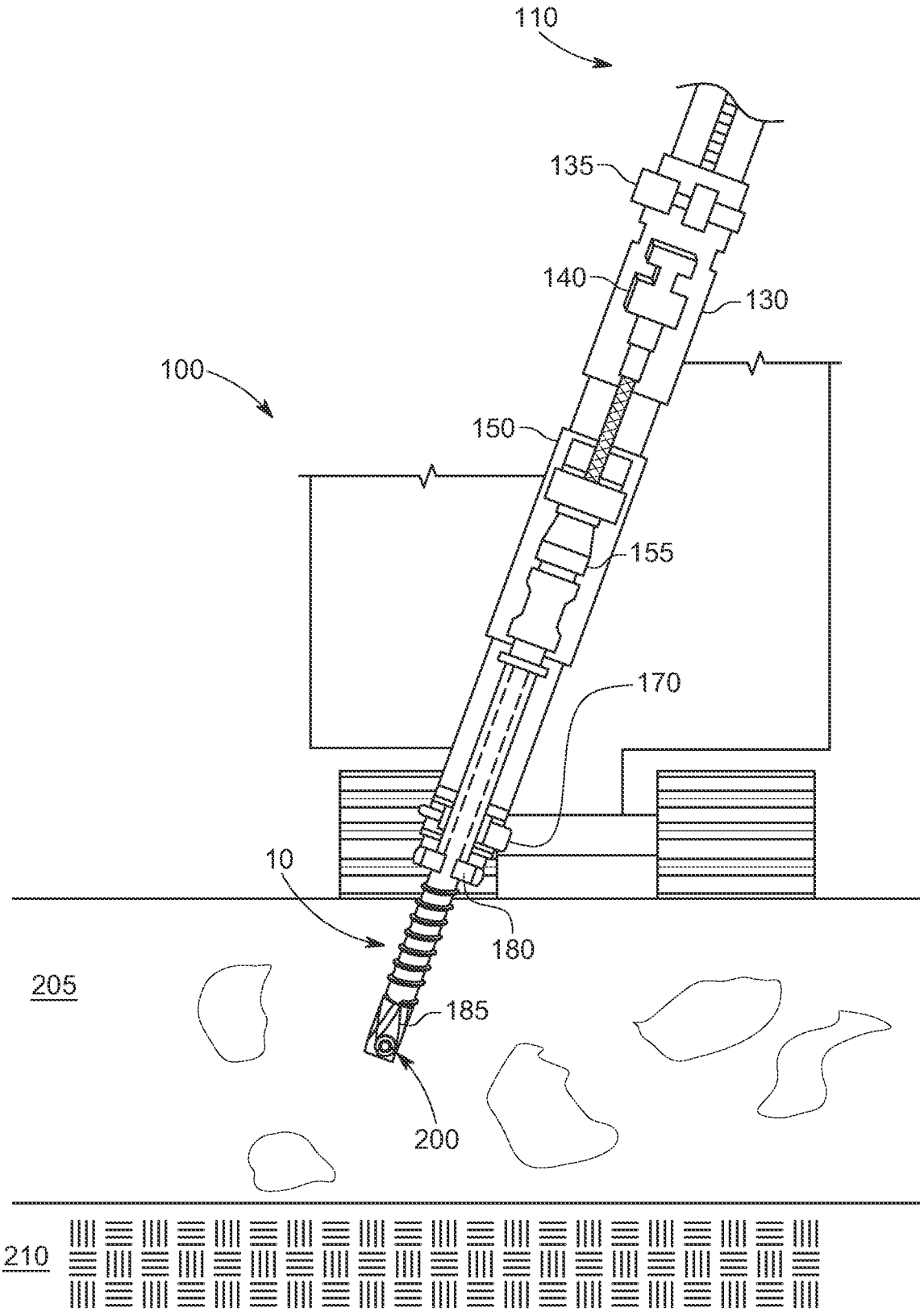
FIG. 3B is a partial mast view of an exemplary machine for driving foundation components and assembling truss foundations engaged in a simultaneous drilling and driving operation.

FIG. 3B, shows truss driver machine 100 of FIG. 3A engaged in an exemplary automated driving operation. During this operation, a foundation component, in this example, screw anchor 10, has been attached to the chuck of rotary driver 155. Before driving commences, the controller controls mast 110 to adjust to the desired driving vector (combination of position, pitch, roll, and yaw), and then engages rotary driver 155 and lower crowd motor 170 to drive the component to the desired embedment depth. Though not shown in FIG. 3A or 3B, the controller may be located in a closed cabinet elsewhere on the machine and may be controlled directly or via a remote control. At the same time as the rotary driver is activated, in various embodiments the controller actives drilling tool 140 to travel down the mast on upper crowd 130 to extend drill bit 185 through the rotary driver 155 and driven component so that drill bit 185 protrudes from the open lower end. In FIG. 3B, drill bit 185 can be seen extending out of the open end of anchor 10 to clear a bore hole 200 for the anchor to be driven into. Though not shown, pressurized air may also be emitted from the drill bit to enable drilling spoils to be ejected up and out of the borehole through the screw anchor. Pressurized air may travel from an onboard air compressor to the drilling tool, and down an air passage formed in the center of the drill rod. In various embodiments, ejected spoils may travel up the foundation component and be shot out of the rotary driver. In various embodiments, a centralizer 180 at the foot of the mast may close around or otherwise engage the foundation component to help keep it from wobbling during embedment. This may be particularly useful since the rotary driver engages the component at its upper end. The controller may control the upper crowd and drilling tool to change its velocity, down force, and/or downward rate of travel to provide more or less drill assist, or, depending on the type of bit used, to increase the frequency and/or force of drill hammering.

Figure 4:
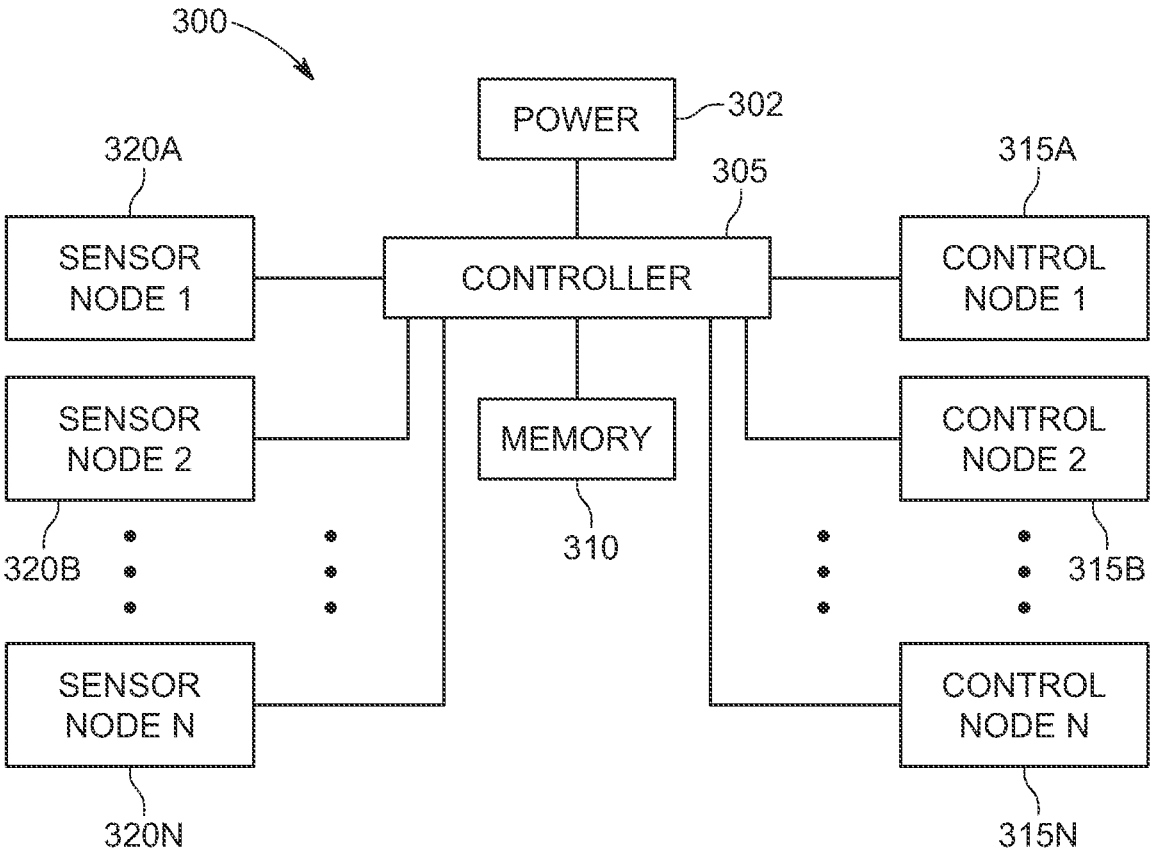
FIG. 4 is a block diagram showing components of an exemplary circuit for controlling a foundation component driving and truss assembly machine to perform an automated screw anchor driving operation according to various exemplary embodiments.

FIG. 4 is a block diagram showing components of an exemplary circuit 300 for automated control of a screw anchor driving or embedment operation with the truss driver machine such as that shown in FIGS. 3A and 3B. Although the components are shown as being physically interconnected in this diagram, it should be appreciated that they may be communicatively coupled via one or more wireless communication links as well, or, in the alternative, a combination of wired and wireless interconnections. Also, block diagram 300 is merely a block representation and does not imply a specific physical topography. It should be appreciated that the components shown in FIG. 4 need not be housed in a single enclosure, and in fact, the sensor nodes and control nodes will be dispersed around the mast.

The heart of the automated control system shown in FIG. 4 is controller 305. Controller 305 may one or more of any commercially available microprocessors such as those available from Intel Corporation. Alternatively, the controller may be an integrated circuit (IC) microcontroller. In still further embodiments, the controller may be a programmable logic controller or PLC. PLCs are manufactured and sold by many companies including Siemens, Rockwell Automation/Allen Bradley, Mitsubishi Electric, Schneider Electric, and Omron to name a few. PLCs are frequently used in machine automation because they support common programming languages (Ladder Diagram, Structured Text, SFC, FBD, and Instruction List) and because manufactures make ruggedized turn-key solutions incorporating enclosures, connectors, data busses and wired and wireless communication protocols that can be easily integrated into heavy equipment and other automated machine applications.

As shown in FIG. 4, the control system includes a separate power supply 302 that takes the native 12 or 24-volt level of the machine down to a voltage suitable for the controller and its interconnected components (i.e., 3 volts). A memory unit 310 is also shown in FIG. 4. Memory unit 310 may reside within the controller or may supplement onboard memory to store program code for operating the machine, for recording data generated during drilling and driving operations, and/or for storing any other suitable data. The remaining components are classified generally as sensor nodes 320A, through 320N, and control nodes 315A, through 315N, where letters A-N are integers. Sensor nodes 320A, through 320N may include one or more sensors on the mast or machine including, but not limited to hydraulic pressure sensors, inclinometers, accelerometers, linear encoders, angular encoders, air pressure sensors, and timers, among others. These sensors may sit in isolation on the machine or mast or may be incorporated into devices operating on the mast. Control nodes 315A, through 315N represent controllable systems and/or devices on the machine or mast. These may include items such as the lower crowd motor, the rotary driver, the tool driver, and the upper crowd motor. These may also include proportioning valves controlling hydraulic fluid flow rates, air flow rates, the mast rotator, the mast X slide, the mast Y slide, mast twist (yaw), mast roll, mast pitch, power (in the case of automated shut off), the hydraulic system, or even the machine itself, among other control nodes.

Once an operator initiates an automated screw anchor driving operation, via human machine interface (HMI) on the machine or via commands issued with a remote control, controller 305, while receiving feedback from one or more of the sensor nodes 320A, through 320N, controls various ones of the control nodes 315A through 315N in accordance with stored program data to orient the mast to the correct driving vector and to initiate the embedment operation to embed a screw anchor or other foundation component to a desired embedment depth. Information from one or more of the sensor nodes 320A, through 320N will enable the controller to determine that the component has reached the target embedment depth so that the automated drive operation may be appropriately terminated upon completion.

In various embodiments, although the driving operations are performed on an automated basis, a handheld or neck-worn remote control may be used to control the machine, that is, to initiate and terminate the automated driving process. Once the operation is initiated, in various embodiments, controller 305 autonomously monitors various performance metrics of the mast components to optimize each operation. However, situations may occur that require manual intervention. For example, while driving, it is possible that spoils may become impacted in the bore hole or the bit may become stuck in a rock or other obstruction. A skilled operator who is paying close attention may be able to detect this stall situation simply by listening to and watching the machine, however, this requires the operator to be constantly paying attention. If missed, this condition could continue to persist undetected leading to immediate damage to one or more of the mast component or foundation component or at least unnecessary wear and tear on the drill bit and machine. Ideally, controller 305 will detect one or more variables from the array of sensor nodes to enable stall conditions to be quickly detected so that they may be mitigated before damage to the drill bit, foundation component, or machine occurs.

Figure 5:
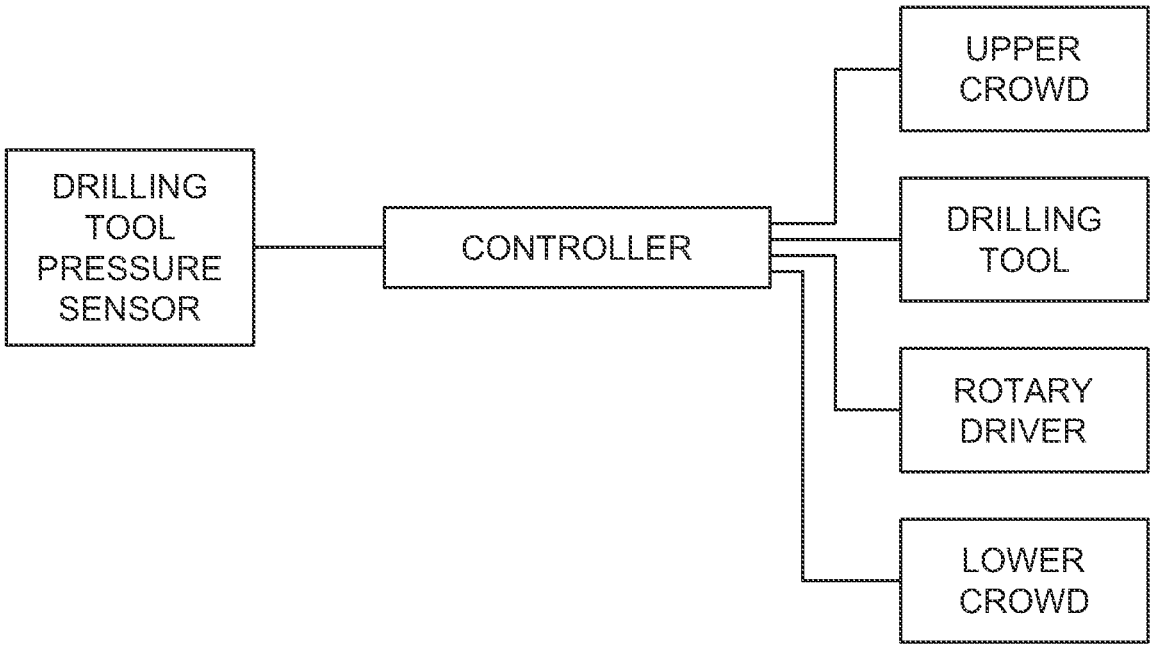
FIG. 5 is a block diagram showing components of an exemplary circuit for detecting and mitigating drill stalls in a foundation component driving and truss assembly machine according to various exemplary embodiments.

To that end, various embodiments of the invention provide systems and methods for using the automated control system used to drive foundation components into the ground with drill assist to quickly detect the occurrence of a situation requiring intervention, to intervene, and to mitigate the situation without any input from the machine operator, or without the machine operator even being aware that it happened. FIG. 5 shows specific elements of an exemplary automated control system for a truss driver machine that can detect and mitigate stalls of the drilling tool based on monitored hydraulic pressure readings at the tool or so-called upper rotary. In drag bit mode, the drilling tool provides torque to the tool bit while the lower crowd motor and, if necessary, the upper crowd motor, provides the downforce for the bit. This is as opposed to rock bit mode which progresses not by friction but rather by percussive hammering. In addition, the drill rod may have a hollow channel through its center to enable compressed air to pass through the rod and drill bit to assist with the ejection of drilling spoils. Drag bits are meant to scrape against the bore surface to break apart rocks and gravel and drill a hole through them whereas rock bits pummel a hole through them. When encountering solid bedrock, such as that shown below the sedimentary layer in FIG. 3B, or when drilling directly into rock without an upper sedimentary layer, a rock drill bit such as a button bit may be used. Button bits have a series of carbide buttons that pummel the rock into gravel and dust through repeated hammering of the drill bit. In such cases, the drilling tool not only rotates but also hammers.

With continued reference to FIG. 5, in this exemplary embodiment, the controller is communicatively coupled to a hydraulic pressure sensor that takes sequential hydraulic pressure readings at the drilling tool. In various embodiments, this information is captured a hundred or more times per second and received and monitored by the controller in accordance with stored program code executed by the controller. In various embodiments, this information may be stored in memory in the controller itself or in a memory coupled to the controller for maintenance or other purposes. In accordance with the control program, the controller monitors the information for the existence of a condition that indicates that a stall has begun. The existence of this condition may be revealed by the values of the pressure readings being clustered together in a narrow band above a predetermined threshold over a unit of time. To mitigate this condition, as discussed in greater detail in the context of FIGS. 6, 7 and 8, the controller may communicate with the upper crowd, drilling tool, rotary driver, and lower crowd to mitigate the stall. In various embodiments, the controller may execute program code that monitors hydraulic pressure in the drilling tool for readings that indicate that a stall is in progress so that the drilling operation may be paused immediately while drill stall mitigation occurs. Once mitigation is complete, which, may in various embodiments also be indicated by monitoring pressure readings for the absence of the condition that indicated the stall in the first place, by monitoring the drill insertion rate or derived from other sensor node information, the program code may instruct the controller to control the upper crowd, drilling tool, rotary driver, and lower crowd to resume the drilling operation in accordance with the program code controlling the operation.

Figure 6:
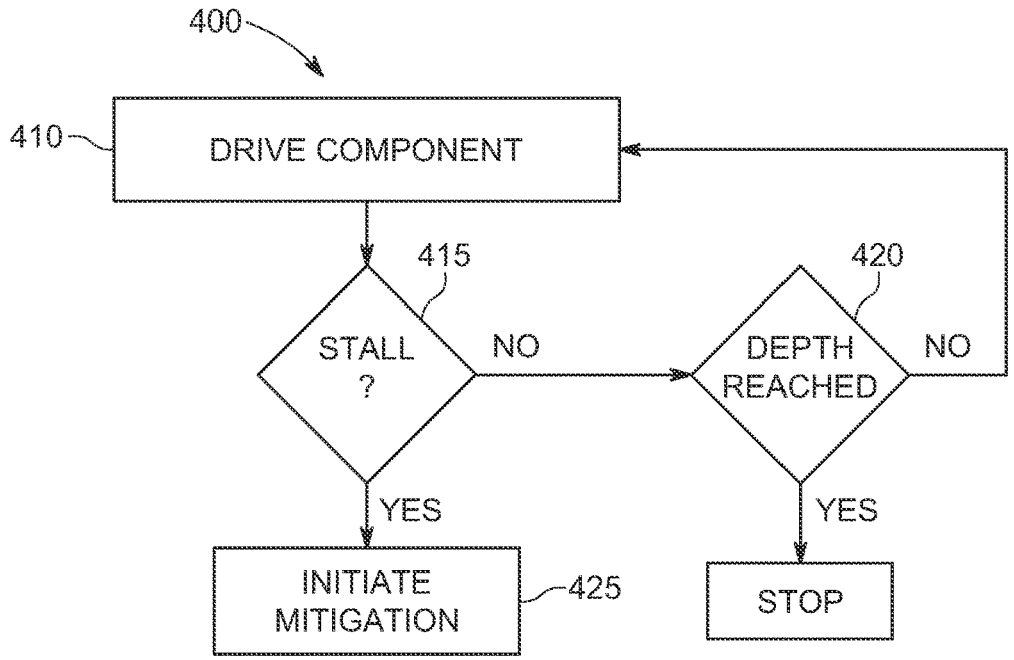
FIG. 6 is a flow chart detailing steps of an automated method for monitoring for a drill stall condition while performing an automated driving operation with a foundation component driving and truss assembly machine according to various exemplary embodiments.
Figure 7:
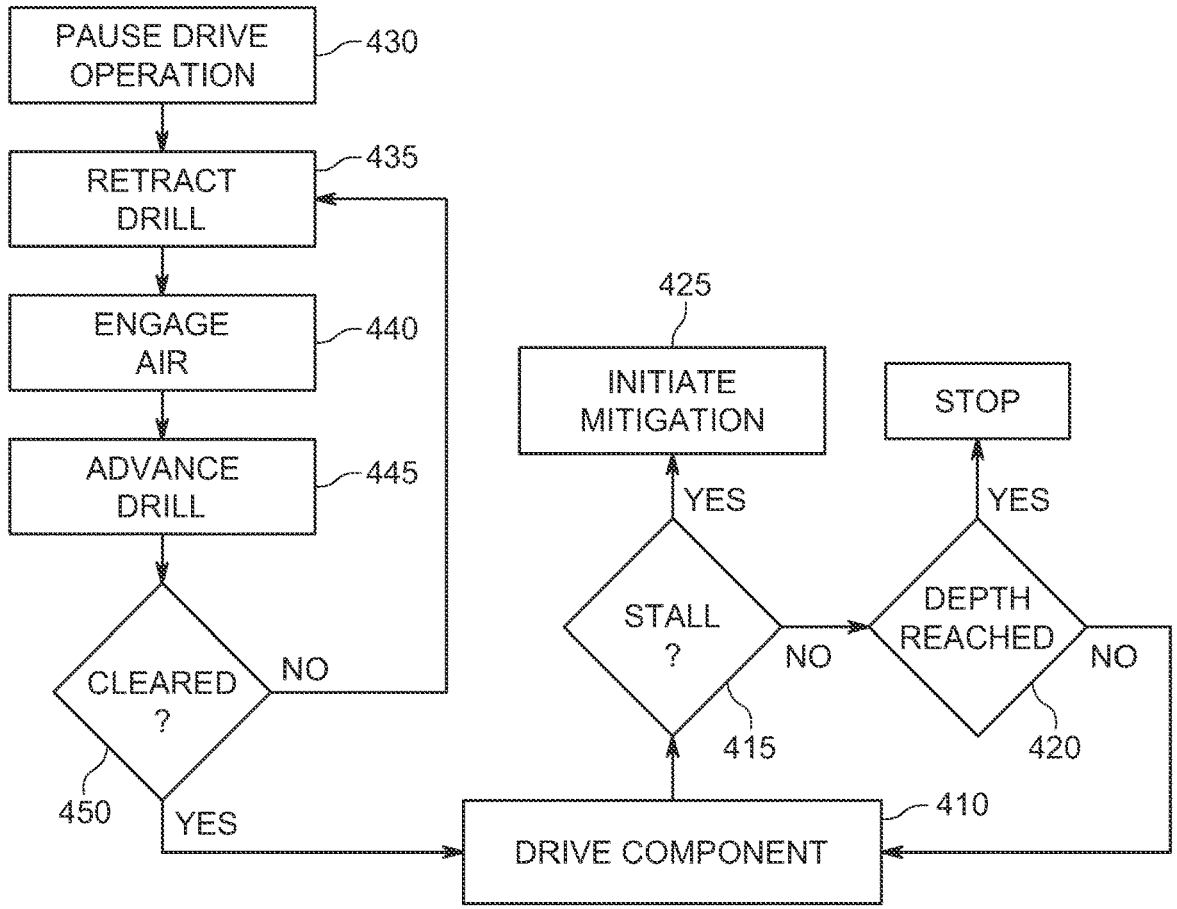
FIG. 7 is a flow chart detailing steps of an automated method for mitigating a drill stall of the of the foundation component driving and truss assembly machine while performing an automated screw anchor driving operation.

Turning now to FIGS. 6 and 7, these figures are flow charts showing the steps of exemplary methods for driving a foundation component while monitoring for stalls and for mitigating stalls, respectively, with a foundation component driving and truss assembly machine such as the truss driver. Beginning with the exemplary method 400 shown in FIG. 6, at step 410, the automated driving operation begins. As discussed herein, in various embodiments, this may be initiated by an operator pressing a start or other button on a remote control for the machine. Alternatively, a button or other physical or soft control on a user interface attached to the truss driver machine may be activated. Initiation of the driving operation causes the controller to take whatever sensor data inputs are required for initial inputs to instruct the lower crowd motor, rotary driver, drilling tool, and if necessary, the upper crowd motor, to begin driving a foundation component with drill assist into the underlying ground in accordance a stored program executed by the controller. In the ordinary course of operation, the combination of downforce and torque imparted by the rotary driver and lower crowd motor, as well as rotation of the drill bit extended through the rotary driver and open lower end of the foundation component, causes the component to embed into the underlying ground along the vector set by the mast. While this occurs, the controller receives pressure sensor readings from one or more sensor nodes providing hydraulic fluid pressure readings from the drilling tool. In various embodiments, this data is sampled at a sufficiently high sample rate to enable a hundred or more readings to be taken each second. In step 415, these readings are continuously reviewed by the controller in accordance with the stored program code to determine if they are indicative of a stall.

Figure 8:
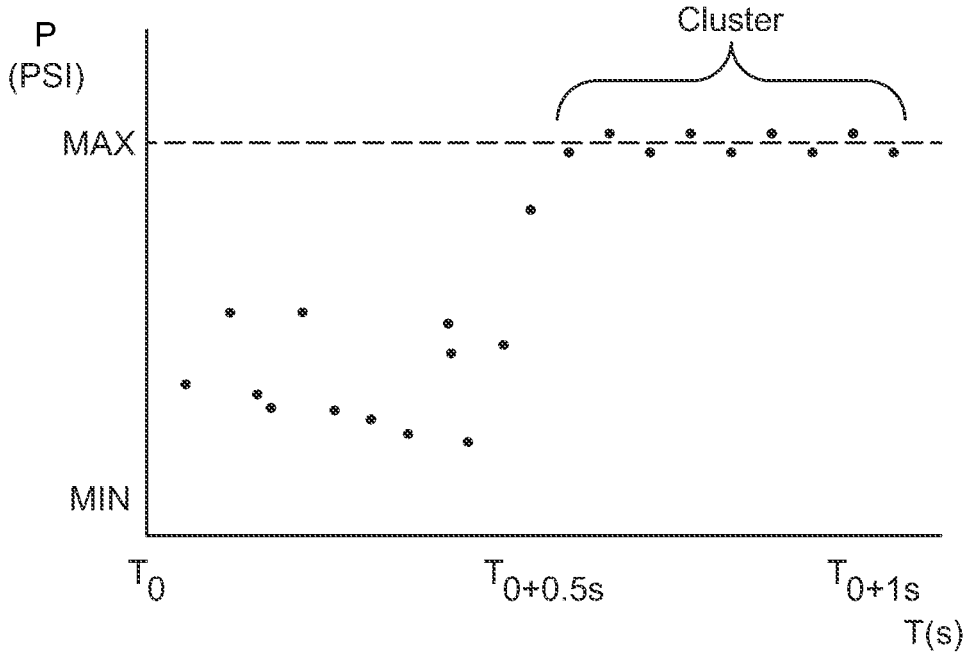
FIG. 8 is an exemplary scatter plot showing hydraulic pressure readings taken from a hydraulic drilling tool of the foundation component driving and truss assembly machine indicative of a stall condition according to various exemplary embodiments.

In various embodiments, and as shown in FIG. 8, a stall is deemed to have occurred when the pressure increases to a relative maximum and subsequent readings are clustered closely around that relative maximum value for a period of time. In this context, clustered closely around implies that a large percentage (i.e., 90-percent) of the values are within 10% of the relative maximum value. As seen in FIG. 8, normal readings are likely to jump around between high and low readings as the drilling tool rotates the drag bit through the bore hole encountering different obstructions. Progress may be momentarily retarded by spoils, harder soil, rocks, changes in soil density or because of other factors causing pressure readings to change. These conditions will account for momentary differences between readings. However, when a stall occurs, rotation stops, causing hydraulic pressure in the drilling tool to spike and remain high. This tight grouping of high-pressure readings over a continuous time period (e.g., ½ second), indicates that the drill has encountered increased resistance and is about to be or is in fact stalled. So, in step 415, if the controller determines that the data points do not indicate a stall, operation proceeds to step 420 where the controller, based on readings from one or more additional sensor nodes (e.g., linear encoder), determines whether the target embedment depth has been reached. If so, the controller is programmed to terminate the driving operation. Otherwise, if not, operation returns to step 410 where the foundation component continues to be driven with drill assist while the controller monitors pressure at the drilling tool. The controller is programmed to continue this cycle until a stall is detected in step 415 or, until the target embedment depth is determined to be reached in step 420.

If, in step 415, the controller determines that a stall is occurring, operation of the program advances to step 425 where stall mitigation is automatically initiated. Stored program code causes the controller to begin executing the exemplary process shown in FIG. 7. The process of FIG. 7 begins in step 430 where the drive operation is paused. Here, in various embodiments, the controller may interrupt the driving operation, instructing the rotary driver and lower crowd motor to stop applying torque and down force, respectively. This is done to protect the foundation component from damage by trying to force it into the jammed bore hole. Then, at step 435, stored program code causes the controller to partially retract the drilling tool, and by extension, the drill rod and bit up into the foundation component. In various embodiments this comprises the controller activating the upper crowd motor to move the upper crowd, and by extension, the drilling tool, rod, and bit, up the mast so that the drill bit is drawn out of the jam. At this point, operation may proceed to step 440. In step 440, the controller may activate a valve to release pressured air out of the drill bit to eject spoils that may be accounting for the stall situation. In other embodiments, compressed air may always be released from the drill bit when the drilling tool is active and, in this step, the flow of air may be increased. In various embodiments, an on-board air compressor feeds compressed air into the drilling tool. The compressed air may, for example, travel down a hollow channel in the center of the drill rod and into a corresponding opening in the body of the drill bit where it is released via one or more ports in the bit. This compressed air should cause spoils to be driven up the foundation component, around the outside of the drill rod but inside the foundation component until it reaches the opening at the point where the rotary driver engages the driving coupler.

Next, in step 445, the stored program code causes the controller to activate the drilling tool and upper crowd motor to advance the drill rod and bit back down into the bore hole while the drill rotates. The upper crowd motor allows the drilling tool to move along the drive train independent of the lower crowd motor, that is, while the rotary tool remains stationary along the mast. As mentioned herein, if a button bit is being used, this will involve hammering the drill bit as well as rotating it. In step 450, hydraulic pressure at the drilling tool is continuously monitored by the controller so that it can determine whether the stall has been successfully mitigated or "cleared" as indicated in FIG. 7. If not, stored program code may cause operation to return to step 435 where the drill is again retracted from the jammed borehole to repeat the mitigation steps.

If, at step 450 the controller determines that the stall has been cleared, as indicated, for example, by pressure readings at the drilling tool returning to normal (i.e., no longer clustered about a relative maximum), stored program code, in the exemplary method shown, may cause operation to return back to step 410 of flow chart 400 of FIG. 6 where the embedment operation is resumed.

Referring again to FIG. 8, this figure is an exemplary scatter plot graphically representing sequential pressure readings that may be taken from a pressure sensor to the controller during an automated driving operation where the drilling tool is providing drill assist. At just past the $T_{0+0.5\ s}$ mark, the pressure readings climb to a relative maximum and cluster around that maximum for the next ½ second. In various embodiments, readings consistent with this pattern may cause the controller to determine that stall condition is in progress and to begin a subroutine to mitigate the stall condition as shown and discussed herein.

Figure 9:
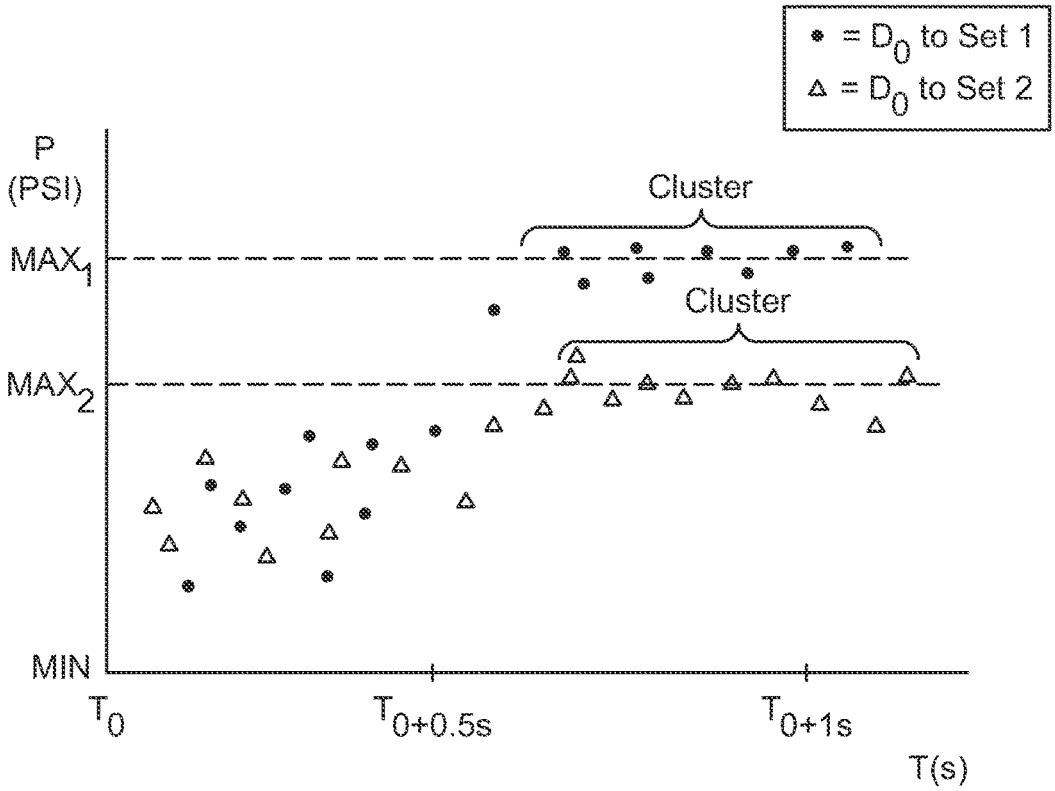
FIG. 9 is another exemplary scatter plot showing two sets of hydraulic pressure readings taken from a hydraulic drilling tool of the foundation component driving and truss assembly machine.

Turning now to FIG. 9, it is possible that in certain situations, the drilling tool may stall but the condition may go undetected and therefore, not automatically mitigated. This may happen if some component of the hydraulic system is not functioning. For example, if the hydraulic compensator valve is not set correctly, that is, it is set too low, the system may generate insufficient hydraulic pressure. The hydraulic compensator valve is supposed to maintain constant hydraulic pressure regardless of the flow rate. If the compensator is not holding pressure at the correct level, a relative maximum may never be detected. The compensator valve is manually adjusted, with a lock nut holding the setting. Over time, machine vibration may loosen the lock nut causing the setting to change. This condition could also be caused by a properly set but malfunctioning compensator valve.

Lower than expected pressure may also happen if the main hydraulic pump pressure is too low. This could be caused by a bad main hydraulic pump or excessive bypass flow in the actuator. Excessive bypass flow happens when one of the internal seals begins to leak enabling flow to the bypass. Even a faulty pressure sensor could prevent the controller from detecting the correct hydraulic pressure thereby preventing stall detection from working when all other hydraulic components are working. Any one of these conditions could potentially prevent the controller from detecting a stall if the relative maximum condition requires hydraulic pressure above a threshold that is either not exceeded or not detected as being exceeded due to bad data. Therefore, in various non-limiting embodiments, it would be useful if the same process that monitors for a stall could be used to detect malfunctioning of the hydraulic system without requiring additional hardware or sensors. For example, if the pressure readings are clustered about a relative maximum that is below the threshold that would indicate a stall.

Turning now to FIG. 9, this figure shows two series of hydraulic pressure readings over a timed interval. Data set one shows a cluster of points in the second half of the time period around a level on the pressure axis labeled as $MAX_1$. Points in this dataset are identified on the graph as dots. Assuming that $MAX_1$ is greater than the threshold set for determining a relative maximum then the stall condition would be recognized based on the clustering of these datapoints by the controller as indicative of an in-progress stall of the drilling tool. For purposes of this example, $MAX_1$ may be 2400 PSI while the minimum stall pressure may be 2300 PSI.

The second data set shown in the graph of FIG. 9 shows points as small triangles. The points in this dataset are clustered around a relative maximum identified on the vertical axis as $MAX_2$. As seen in the graph, $MAX_2$ is a lower pressure level than $MAX_1$. For purposes of this example, it may be assumed that $MAX_2$ is 1900 PSI, that is, below the minimum stall pressure. If the program code routine looking for clustering around a relative maximum requires that those points exceed a threshold level of 2300 PSI then the stall condition, though occurring, will not be detected. Therefore, in both cases a stall is occurring, however, in only one case will the stall be detected. As a result, the mitigation routine will not be invoked, and the drilling operation will stall requiring manual intervention to mitigate From the operator's perspective the machine will be malfunctioning because it may repeatedly stall and will not mitigate drill stalls on its own. Since the stall monitoring and mitigation routine is already confirming whether the recorded pressure readings are clustered around a relative maximum below the expected threshold, a maintenance or service flag may be triggered to the human machine interface indicating that the hydraulic system requires service. This may take the form of a light or a message on a user interface of the installation and assembly machine, as shown, for example, in the non-limiting example of FIG. 12.

Figure 10:
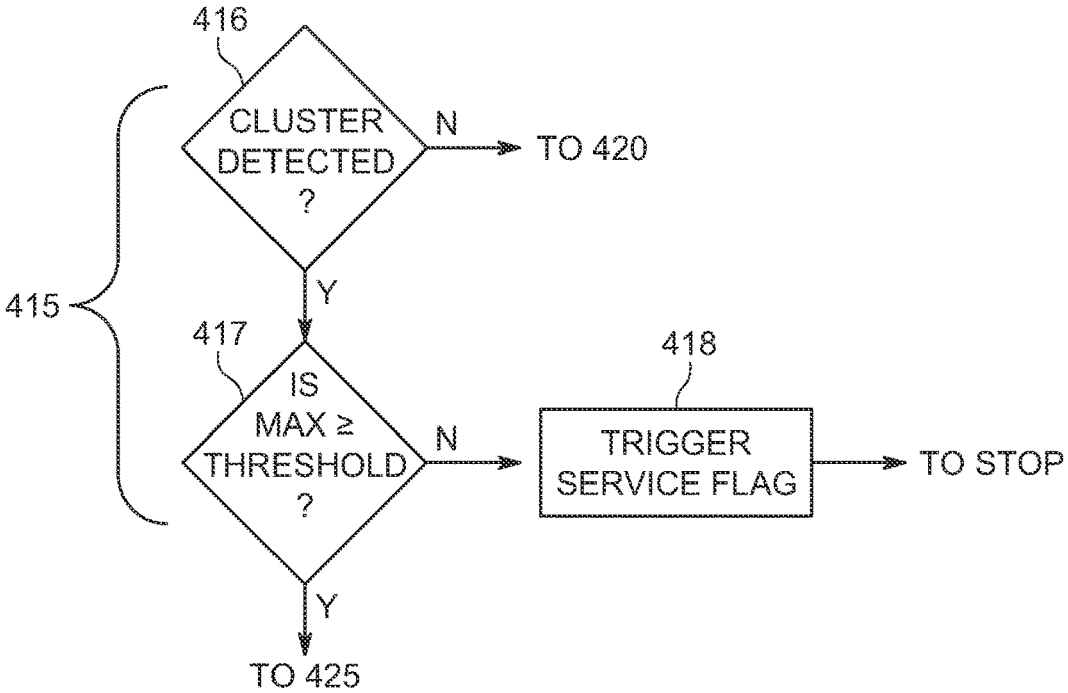
FIG. 10 is a flow chart detailing steps of a method for determining whether a maintenance flag should be triggered based on clustering of hydraulic pressure readings according to various exemplary embodiments.
Figure 11:
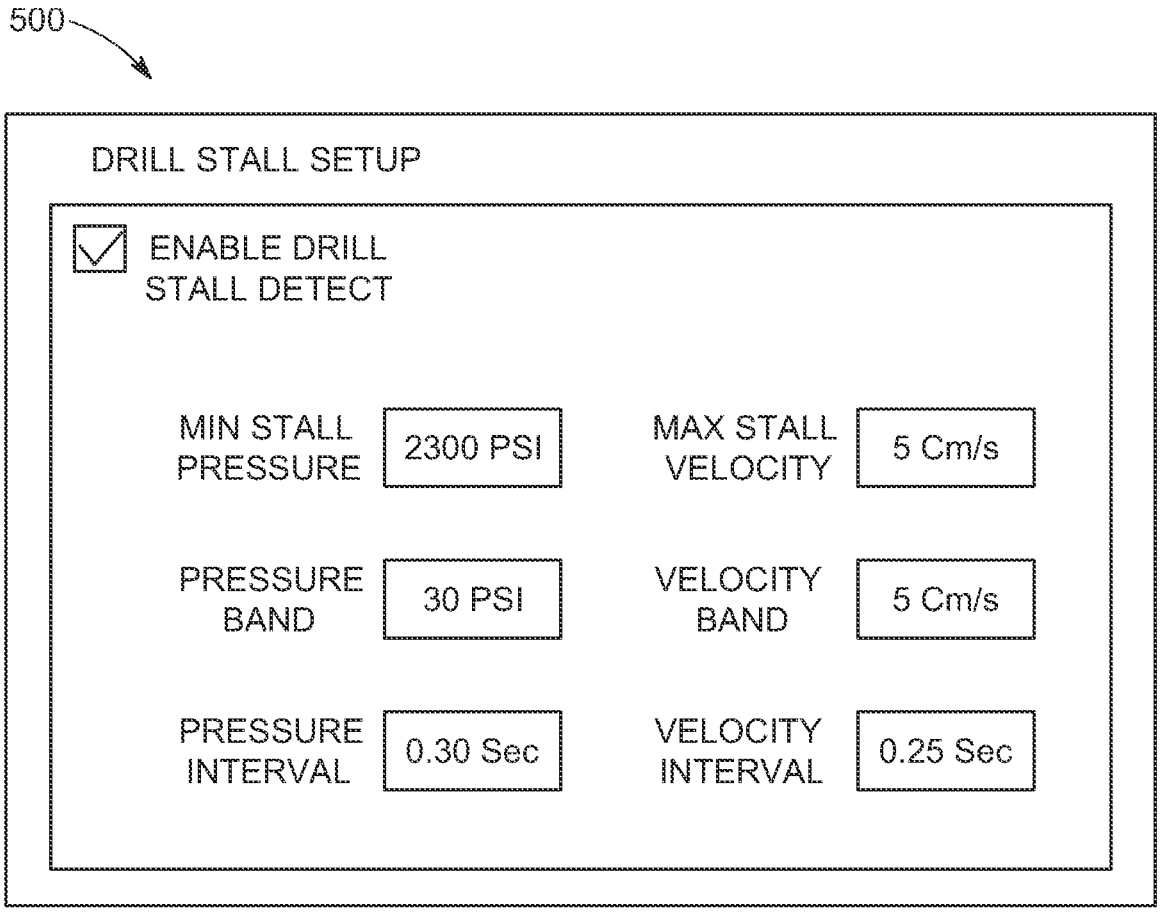
FIG. 11 shows an exemplary user interface screen for setting a drill stall pressure level according to various embodiments.

FIG. 10 is a flow chart detailing the steps of a method or subroutine that may be included in step 415 of the flow chart of FIG. 6. In determining in 415 whether a stall has occurred, the controller may determine if a cluster of points has been detected. In various embodiments, as explained herein, this may be deemed to have occurred when 90-95% of the datapoints are concentrated in a narrow (<50 PSI) band. If not, processing moves from step 416 to step 420 of FIG. 6. Otherwise, processing moves to step 417 where the controller determines if the cluster is above a predetermined threshold. In various embodiments, and as shown in FIG. 11, the max threshold may be set by the operator before use. In this example, if the threshold is not exceeded, operation moves to step 418 where a service flag is triggered, and the driving operation stops. Otherwise, if at 417 it is determined that the threshold is exceeded, operation jumps to step 425 where the stall mitigation routine is initiated.

Turning now to FIG. 11, this figure shows a portion of an exemplary human machine interface (HMI) screen of a foundation installation and truss assembly machine according to various exemplary embodiments. This portion of the HMI relates to the automated drill stall detect and mitigation function described herein and includes a check box for enabling the automated drill stall detect routine as well as input controls for various routine parameters including, in this example, minimum stall pressure, the size of the pressure band indicative of a cluster, the pressure interval, the max stall velocity, the velocity band and the velocity interval. In various non-limiting exemplary embodiments, the minimum stall pressure setting specifies the minimum level in PSI of a cluster of pressure readings required to be indicative of a stall. Of course, this setting could be set arbitrarily low, however, doing so would engage the stall routine more often than necessary slowing down the rate at which foundation components are driven. For example, when drilling first begins, pressure points may be clustered around a relatively low level simply because the soil is relatively uniform.

In various embodiments, the pressure band and pressure interval parameters specify the time period and range of pressure readings required to constitute a cluster for purposes of stall detection and mitigation. As discussed herein, if any hydraulic component or any pressure sensors are not functioning properly, the pressure may never exceed the threshold. Therefore, when checking to see if the clustering of points is about a level that is below the threshold, it is possible to make a determination that one or more of the hydraulic components may not be working properly and, as a result, to trigger a maintenance or error flag on the HMI. This is shown, for example, at FIG. 12.

Figure 12:
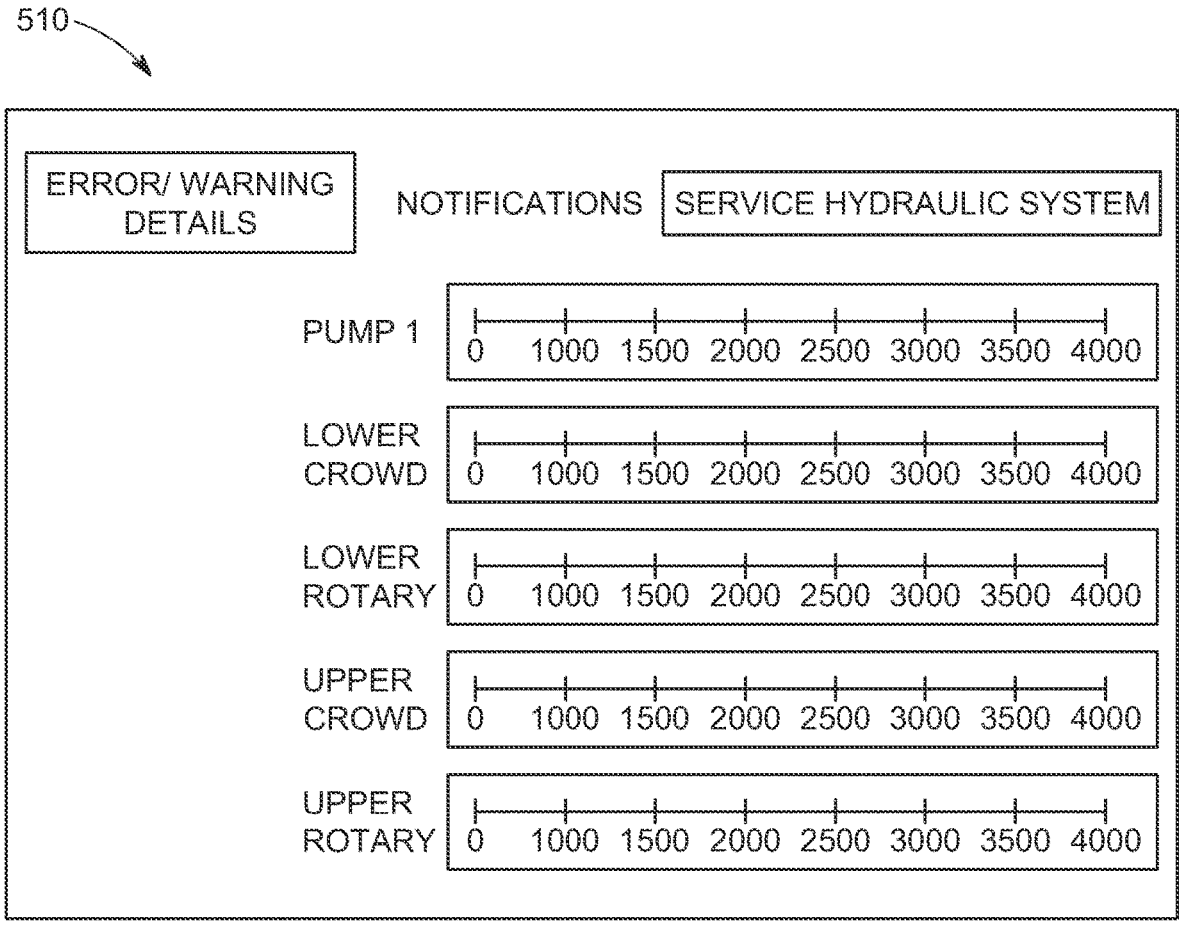
FIG. 12 shows another exemplary user interface screen for viewing error/warning notification according to various embodiments.

FIG. 12 shows another portion of an exemplary HMI screen showing error/warning details according to various exemplary embodiments. In the exemplary interface of FIG. 12, a service flag has been triggered in the notifications portion of the screen. Below are all the monitored systems with pressure bars to show the pressure at the main pump, the lower crowd (drive chain power), the lower rotary, the upper crowd (independent drilling tool power) and the upper rotary (drilling tool). These readings are taken in real time and therefore may or may not indicate a failure of a hydraulic system component or sensor at any given moment in time without the service flag being triggered.

It should be appreciated that the embodiments described and claimed herein are exemplary only. Those of ordinary skill in the art will appreciate modifications and substitutions that retain the spirit and scope of the invention. Thus, such modifications are intended to fall within the scope of the following appended claims. For example, although the various embodiments have been described in the context of a truss driver machine, it should be appreciated that various embodiments of the invention may be equally applicable to machines that drive conventional H-piles such as vibratory and percussive hammering machines and solar pile driving machines that combine a small drilling rig with a pile driver. Therefore, although some of the embodiments of the present invention have been described herein in the context of a particular implementation in a particular environment for a particular purpose, those of ordinary skill in the art will recognize that this disclosure's usefulness is not limited thereto and that the embodiments of the present inventions can be beneficially implemented in any number of environments for any number of purposes. Accordingly, the claims set forth below should be construed in view of the full breath and spirit of the embodiments of the present invention as disclosed herein. Thus, such modifications are intended to fall within the scope of the following appended claims. Further, although some of the embodiments of the present invention have been described herein in the context of a particular implementation in a particular environment for a particular purpose, those of ordinary skill in the art will recognize that its usefulness is not limited thereto and that the embodiments of the present inventions can be beneficially implemented in any number of environments for any number of purposes.

The invention claimed is:

1. A machine for driving foundation components, the machine comprising:

a tracked chassis;

an adjustable mast attached to the tracked chassis;

a rotary driver, movably attached to the mast and controllable to drive a foundation component into underlying ground to a desired embedment depth;

a drilling tool movably attached to the mast and controllable to operate a drill rod through the rotary driver and foundation component; and a control system including a controller executing a control program for automatically controlling the rotary driver and the drilling tool to drive the foundation component to the desired embedment depth with assist from the drilling tool, wherein the control program contains program code causing the controller to detect malfunctioning of a hydraulic system powering the drilling tool by monitoring hydraulic pressure sensor data comprising a series of sequential pressure readings from within the drilling tool to detect a stall of the drilling tool and to generate a service flag when the stall of the drilling tool is detected.

2. The machine according to claim 1, wherein the program code that instructs the controller to monitor hydraulic pressure sensor data from within the drilling tool causes the controller to determine if the hydraulic pressure sensor data indicates a distribution of values that are clustered around a relative maximum pressure reading.

3. The machine according to claim 2, wherein determining if the hydraulic pressure sensor data indicates a distribution of values that are clustered around a relative maximum pressure reading comprises determining a relative maximum value from the hydraulic pressure sensor data and determining if during a predetermined time period most pressure readings are within 10 PSI of the relative maximum value.

4. The machine according to claim 3, wherein most comprises at least 90% of the pressure readings.

5. The machine according to claim 2, wherein determining if the hydraulic pressure sensor data indicates a distribution that are clustered around a relative maximum pressure reading comprises determining if the relative maximum pressure reading exceeds a pre-set threshold and if not, generating the service flag for the hydraulic system.

6. A stall mitigation and fault detection system for an automated foundation component embedment machine, the system comprising:

a plurality of control nodes at the machine, the plurality of control nodes comprising a rotary driver and a drilling tool, the drilling tool controllable to operate a drill rod through the rotary driver and a foundation component;

a controller executing stored program code for controlling the rotary driver and the drilling tool of the machine to embed the foundation component into underlying ground; and a plurality of sensor nodes, wherein the program code causes the controller to control the control nodes to begin an automated operation to embed the foundation component into the underlying ground, and, based on an output of hydraulic pressure data that comprises a series of sequential pressure readings from within the drilling tool from at least one of the sensor nodes, to determine that a stall of the drilling tool has occurred while performing the automated operation to embed the foundation component.

7. The system according to claim 6, wherein the program code causes the controller to generate a service flag for a hydraulic system while determining whether a stall of at least one of the control nodes has occurred.

8. The system according to claim 7, wherein the stored program code causes the controller to determine that a stall of at least one of the control nodes has occurred when the output of the at least one sensor node indicates a distribution of the series of sequential pressure readings from within the drilling tool are clustered around a relative maximum value.

9. The system according to claim 8, wherein the stored program code causes the controller to determine that a service flag should be generated when the output of the at least one sensor node indicates the distribution of the series of sequential pressure readings from within the drilling tool are clustered around the relative maximum value that is below a predetermined pressure threshold.

10. The system according to claim 9, wherein the output of the at least one sensor node indicates the distribution of the series of sequential pressure readings from within the drilling tool are clustered around the relative maximum value when at least 90-percent of the readings are within 10 PSI of that relative maximum value during a pre-determined time period.

11. The system according to claim 6, wherein the drilling tool is a hydraulic drifter drilling tool.

12. A method of controlling an automated machine for driving foundation components, the method comprising:

with a digital controller communicatively coupled to the automated machine, executing stored program code causing the controller to control at least a rotary driver and a drilling tool of the automated machine to attempt to embed a screw anchor into underlying ground to a target embedment depth, the drilling tool being controllable to operate a drill rod through the rotary driver and the screw anchor; and with the digital controller, executing stored program code causing the controller to monitor hydraulic pressure data from at least one pressure sensor connected to at least the drilling tool of the automated machine, the hydraulic pressure data comprising a plurality of pressure measurements from within the drilling tool, to determine if a stall of the drilling tool has occurred and to mitigate the stall before continuing to attempt to embed the screw anchor, wherein the stored program code causing the controller to monitor hydraulic pressure data from the at least one pressure sensor also causes the controller to determine if a hydraulic system powering the drilling tool requires servicing based on the step of monitoring.

13. The method according to claim 12, wherein executing stored program code causing the controller to control the automated machine to attempt to embed a screw anchor into underlying ground to a target embedment depth comprises controlling with the digital controller at least the rotary driver, a drive train, and the drilling tool to attempt to embed the screw anchor.

14. The method according to claim 13, wherein the stored program code causes the controller to detect the occurrence of a stall by monitoring the hydraulic pressure data of the at least one pressure sensor sensing hydraulic pressure at the drilling tool and determining that a stall has occurred if the hydraulic pressure data indicates that a distribution of the plurality of pressure measurements from within the drilling tool are clustered around a relative maximum pressure reading.

15. The method according to claim 14, wherein determining that a stall has occurred if the hydraulic pressure data indicates the distribution of the plurality of pressure measurements from within the drilling tool are clustered around the relative maximum pressure reading comprises determining the relative maximum pressure reading from the hydraulic pressure data of the at least one pressure sensor during a predetermined time period and determining if at least 90 percent of the values are within 10 PSI of that maximum pressure reading.

16. The method according to claim 15, wherein the stored program code causes the controller to determine if the hydraulic system powering the drilling tool requires servicing based on the step of monitoring by determining if the hydraulic pressure data indicates the distribution of the plurality of pressure measurements from within the drilling tool are clustered around the relative maximum pressure reading that is below a predetermined threshold.

* * * * *